US006481104B1

(12) United States Patent
Parker et al.

(10) Patent No.: US 6,481,104 B1
(45) Date of Patent: Nov. 19, 2002

(54) VIBRATING SHAVING SYSTEMS

(75) Inventors: Andrew Parker, Sausalito, CA (US); Charles E. Taylor, Sebastopol, CA (US)

(73) Assignee: Sharper Image Corporation, San Francisco, CA (US)

( * ) Notice: Subject to any disclaimer, the term of this patent is extended or adjusted under 35 U.S.C. 154(b) by 0 days.

(21) Appl. No.: 09/668,607

(22) Filed: Sep. 22, 2000

(51) Int. Cl.[7] ..... B26B 21/40; B26B 21/52
(52) U.S. Cl. ..... 30/45; 30/527
(58) Field of Search ..... 30/45, 42, 527, 30/534, 526

(56) References Cited

U.S. PATENT DOCUMENTS 5,046,249 A * 9/1991 Kawara et al. ..... 30/45

* cited by examiner

*Primary Examiner*—Douglas D. Watts
(74) *Attorney, Agent, or Firm*—Fliesler Dubb Meyer & Lovejoy LLP

(57) ABSTRACT

A shaving system for use with mechanical hand-held shavers includes a housing in which is disposed a DC motor, an eccentric weight coupled to a shaft of the motor, and a DC power source. The eccentric weight and motor shaft are oriented such that the axis of vibrations produced by the motor are parallel to an axis of the cutting edge of a razor blade attached to a handle in mechanical vibratory communication with the motor. The result is vibratory displacement of the razor blade, typically back-and-forth, over a range approximating the dimension of a human hair. In one embodiment a housing accepts the handle of a generic shaver, and in a second embodiment the housing is bifurcated and the handle of a shaver.

16 Claims, 2 Drawing Sheets

VIBRATING SHAVING SYSTEMS

FIELD OF THE INVENTION

The present invention relates generally to shaving body hair, and more particularly to shaving systems that mechanically reduce friction in an attempt to make the shaving process more comfortable.

BACKGROUND OF THE INVENTION

Shaving is a straightforward process: one simply shears off one's whiskers (or other body hair) with a very sharp blade. Manual shaving systems include a user holdable handle to which a razor blade that is very sharp when new is removably attached. Although not especially relevant to the present invention, conventional electric shavers use a rotating cutting razor edge that must be sharpened periodically.

But even shaving with the sharpest cutting edge can still be an irritating and uncomfortable process, due in part to friction between the skin of the person shaving, and the cutting surface of the razor blade or electric shaver. Shaving creams and lotions can help, but residual friction still remains with the result that the shaving experience is often uncomfortable.

Thus there is a need for a shaving system that renders the process of shaving more comfortable. Preferable such system should be relatively inexpensive, lightweight, and easy to use. Further the system should be useable with conventional razor blades, and preferably with conventional razor handles as well.

The present invention provides such a shaving system.

SUMMARY OF THE INVENTION

In a first aspect the invention provide a system that includes a hand-holdable housing sized to retain the shaft or handle portion of a manual shaver, such that a portion of the distal tip that is adapted to retain a conventional razor blade emerges from the housing. Also disposed within the housing is a battery, a DC motor, and an eccentric weight coupled to the shaft of the motor. An ON/OFF switch operable from the housing exterior enables a user to turn the motor on and off. Preferably the vibration axis of the eccentric weight is parallel to the cutting axis of the razor blade attached to the handle, such that blade vibration is constrained essential to a back and forth motion along a single axis. The eccentric weight and motion rotation are designed to achieve a back and forth motion that approximates the width of a human hair, perhaps about 0.004".

A "U"-shaped channel of resilient material surrounds the neck portion of the retained handle, and the "U"-shaped channel itself fits tightly within a removable collar that fits within the opening in the housing. Thus the handle is inserted rear-end first into the housing, and is securely retained by the resilient material and removable collar. In this fashion a generic manual shaver handle is securely retained by the housing. Optionally a small metal plate is disposed within the housing, to be attracted to a quarter-sized magnet disposed in the base of a small suction-cup accessory that may be attached to a mirror, bathroom wall tile, or other smooth surface. Magnetic attraction between the magnet and the metal plate within the housing enables the suction cup to retain the invention in convenient location.

To shave, the user simply turns the switch ON, thus electrically coupling the battery to the winding on the DC motor. The resultant rotation of the eccentric weight vibrates the shaver handle tip such that the attached razor blade vibrates in a desired fashion. Friction between the vibrating razor blade and user's skin is reduced and a more comfortable shaving session is experienced.

In a second, more compact and preferred aspect, the present invention provides an elongate bifurcated handle-like housing that substitutes for the handle of a conventional manual razor. A battery, DC motor with eccentric weight on the motor shaft, and ON/OFF power switch are disposed in the housing. The handle-like housing has a main housing portion that the user holds and within which batteries and an ON/OFF switch are located. The handle-like housing also has an end housing portion that is pivotably attached at one end by a pivot axle to the main housing portion, and whose other (free) end is adapted to receive a standard razor that is disposably attached. A DC motor and eccentric weight are disposed within the end housing portion. When the user turns on the switch, the DC motor is coupled to the battery and the rotating eccentric weight vibrates the distal tip of the handle, and the conventional razor mounted thereon. As with the first aspect, eccentric weight vibration is preferably parallel to the razor blade axis such that a back and forth vibratory movement of the blade is produced, having a movement dimension preferably approximating a human hair in displacement.

In each embodiment, the vibrating razor advantageously reduces friction and can result in a more comfortable shave.

Other features and advantages of the invention will appear from the following description in which the preferred embodiments have been set forth in detail, in conjunction with the accompanying drawings.

DETAILED DESCRIPTION OF THE PREFERRED EMBODIMENTS

Figure 1:
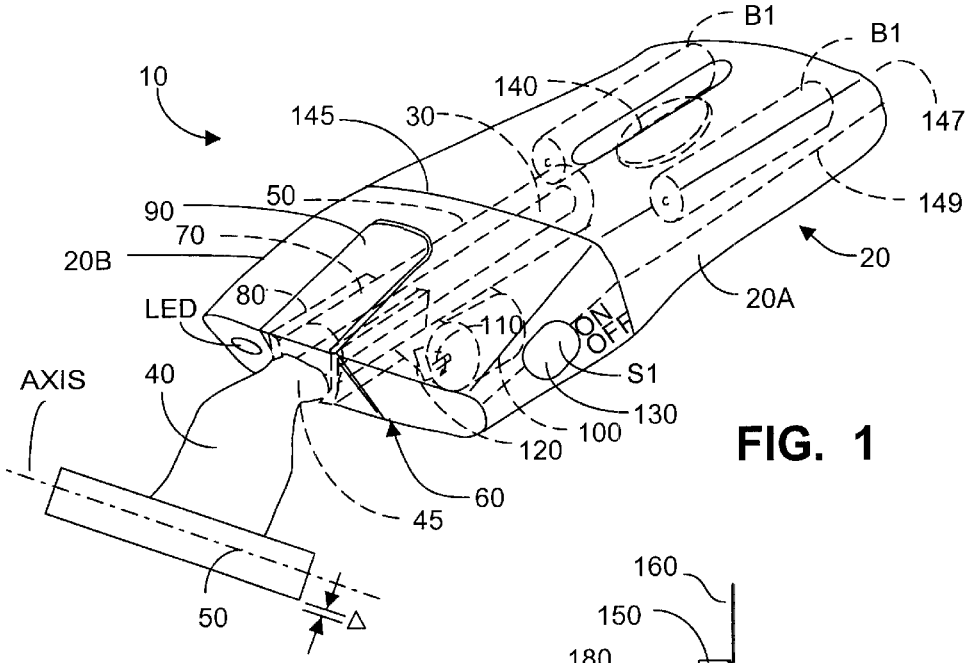
FIG. 1 is a perspective cutaway view of a first embodiment of the present invention.

FIG. 1 depicts a first embodiment of a shaving system 10, according to the present system. System 10 includes a handholdable housing 20, preferably made of a lightweight and durable material such as ABS plastic. Disposed within housing 20 is the handle portion 30 of a standard or generic manual shaver, whose distal tip 40 projects from an opening 45 formed in the front surface 60 of housing 20. Distal tip 40 is adapted to receive and retain a standard replaceable razor blade. In the preferred embodiment, handle portion 30 is disposed within housing 20 in a channel-like region 70.

Before handle portion 30 is inserted into channel 70, the neck region of the handle portion 40 is surrounded by a "U"-shaped material 80 that fits within a collar member 90 that slides frictionally into the front portion of housing 20. Opening 45 preferably is formed in the front portion of collar 90. Material 80 preferably is a resilient material such as rubber and serves to frictionally retain the neck region of the shaver handle securely in place.

A user inserts the handle portion 30 of a standard manual shaver into housing 20 by first sliding collar 90 forward, to remove the collar from front of the housing. "U"-shaped material 80 is removed from member 90 and is formed about the neck portion of handle 30, and then reinserted into member 90. Member 90, with the tail-end of handle 30 extended into channel 80 is then reinserted into housing 20. Preferably grooves and channels on mating surface of housing 20 and collar 90 frictionally retain the collar securely in place. "U"-shaped material 80 compressively secures the shaver within the housing, with only the distal tip 40 extending out of the housing. A conventional razor 50 is attached to distal tip 40 in standard fashion, e.g., by sliding onto tip 40, or by mating with projections or depressions in tip 40, etc., depending upon the brand and model of razor 50.

A small DC motor 100 is secured within housing 10 to channel 80, and the motor shaft 110 is secured to an eccentric or off-center weight 120. Motor 100 preferably can rotate at a speed of several thousand RPM, for example 4,000 RPM to 8,000 RPM with a few volts DC coupled to the motor winding. The geometry of the offset weight is selected to produce a mechanical vibratory excursion (Δ) at the cutting edge of the razor blade affixed to system 10 of about $4/1{,}000$ inch, e.g., about the thickness of a human hair. Experimentation has shown that a motor vibration in the range indicated will suffice, whereas a higher rotational speed tends to reduce the vibratory excursion of the blade. Further, a user should not experience discomforting vibrations while holding shaving system 10 in hand for use.

Also secured within housing 20 is a DC battery power supply, for example one (or preferably two) AA 1.5 VDC batteries (B1) that are used to energize motor 100. A simple ON/OFF push switch S1 is activated by the user pushing on a rubber portion 130 disposed in the housing surface over an opening (not shown). A shaft extending from S1 is pushed into the switch when the user pushed on rubber portion 130 to toggle the switch between ON, OFF, ON, etc. The rubber nature of portion 130 contributes to the water resistance of housing 20. Housing 20 preferably also retains a light emitting diode (LED) that can be illuminated when switch S1 is ON.

As described later herein, a metal disk or plate 140 may also be attached to the inner surface of the housing, for potential use in mounting system 10 to a wall, shower tile, mirror, or other flat surface when not in use. Plate 140 is perhaps a 0.5" or so square, or a 0.5" diameter circular piece of steel that is perhaps 0.375" thick. Preferably housing 20 is fabricated as two housing portions 20A, 20B that mate at junction 145, such that housing portions 20A, 20B may be pulled apart to gain access to batteries B1 for purposes of replacement. Alternatively a battery access door 147 could instead be provided for purposes of replacing batteries B1.

As noted housing 20 is handholdable in size, and preferably has a form factor similar to a bar of soap. With a razor 50 attached to distal tip 40 of the shaver, the user turns S1 on, whereupon motor 100 begins to rotate shaft 110. The eccentric nature of weight 120 intentional produces vibrations that are mechanically coupled to the neck (or razor) region of shaver 30. In the preferred embodiment, vibrations are about a vertical pivot point, which tends to constrain vibrations to a single axis parallel to the cutting axis (AXIS) of blade 50.

For ease of use, it is desired that motor produced vibrations be confined to the head region of system 10 where they are needed, and that relatively minimal vibrational energy be transferred to the user's hand. This is achieved in the preferred embodiment by causing the vibration axis of weight 120 to be parallel to the axis of the razor (denoted AXIS in FIG. 1). As a result, vibrational energy in the head region of system 10 causes razor 50 to tend to move in and out, a distance Δ, as opposed to moving sideways, left and right. An alternative motor-weight configuration might be used in which a horizontal rather than a vertical pivot point were employed, in which case vibratory up and down motion of the razor 50 would be induced.

During operation, with a shaver handle 30 retained within housing 20 and a razor blade 50 attached to the distal end of the shaver, a user presses S1 and holding housing 20, begins to shave. The vibratory motion imparted by the present invention to the cutting edge of razor 50 tends to reduce friction and reduce the discomfort often associated with shaving.

Figure 2:
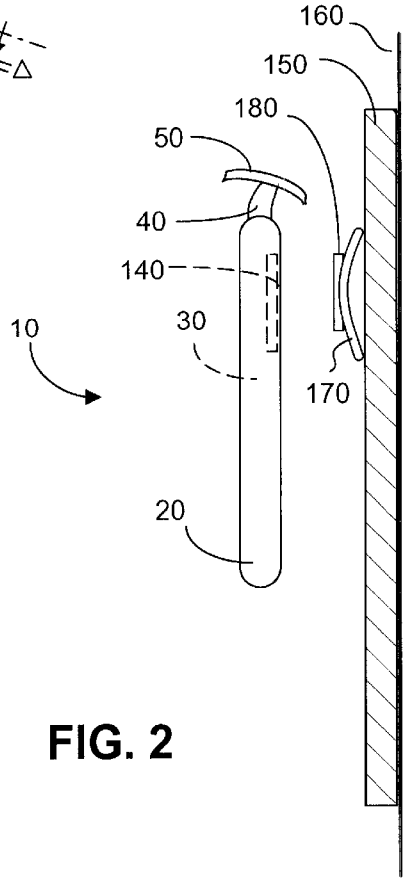
FIG. 2 is a side view showing the embodiment of FIG. 1 about to be magnetically secured to a suction device attached to a planar surface, according to the present invention.

FIG. 2 depicts assembly 10 in the process of being secured to a flat surface such as a mirror 150, perhaps secured to a wall 160. Of course surface 150 might be the flat portion of bathroom tile, perhaps within a shower, or a suitably flat wall portion. System 10 may include a suction cup member 170 that retains a magnet 180. Suction cup member 170 attaches by vacuum to a flat surface 150, and will magnetically attract the metal plate or disk 140 within housing 30. For example, a quarter-sized rare earth neodymium magnet 140 can support several pounds, and will readily support the overall weight of system 10 and a retained shaver 30. When system 10 is to be stored, housing 20 is simply held near magnet 180, which may be concealed by the rubber or plastic material from which suction cup member 170 is fabricated. Magnetic attraction will retain housing 20 in place until further use is desired, at which time the user simply pulls or pries away housing 20 from magnet 180. If desired, location of magnet 180 and metal plate 140 could be exchanged.

Although system 100 has been described with respect to a housing 20 that retains a shaver 30 that is inserted handle end first into the housing interior, those skilled in the art will appreciate that housing 20 could instead be fabricated in clam-shell fashion. In a clam-shell embodiment, housing 20 could be fabricated as upper and lower halves removably joined together at a seam 149. The two halves could be hinged together, or could simply snap together to join at seam 149. If desired, the user could be provided with rubberized inserts having cavities formed for various brands of shavers and could select an appropriate insert or inserts for a desired shaver, place the shaver and inserts within the clam-shell housing and close the housing to retain the shaver in position.

One advantage of the embodiment of FIGS. 1 and 2 is that a user may change the type of shaver 30 and therefore the type of blade 50 used. For example, after using a given model shaver for a year or two, during which time there would be no need to remove shaver 30 from housing 20, the user might wish experiment with a new model shaver. It suffices to slide member 90 outward, away from housing 20, and to remove member 90, rubber-like "U"-shaped element 80, and shaver 30 from the housing. A new shaver 30 or a new model shaver 30 could now be inserted into the "U"-shaped element 80, which would be reinserted in collar 90. Collar 90, element 80, and the new shaver 30 are now slid into housing 30, after which an appropriate razor blade 50 may be attached to the projecting distal end of shaver 30, and system 10 is ready for use.

Figure 3:
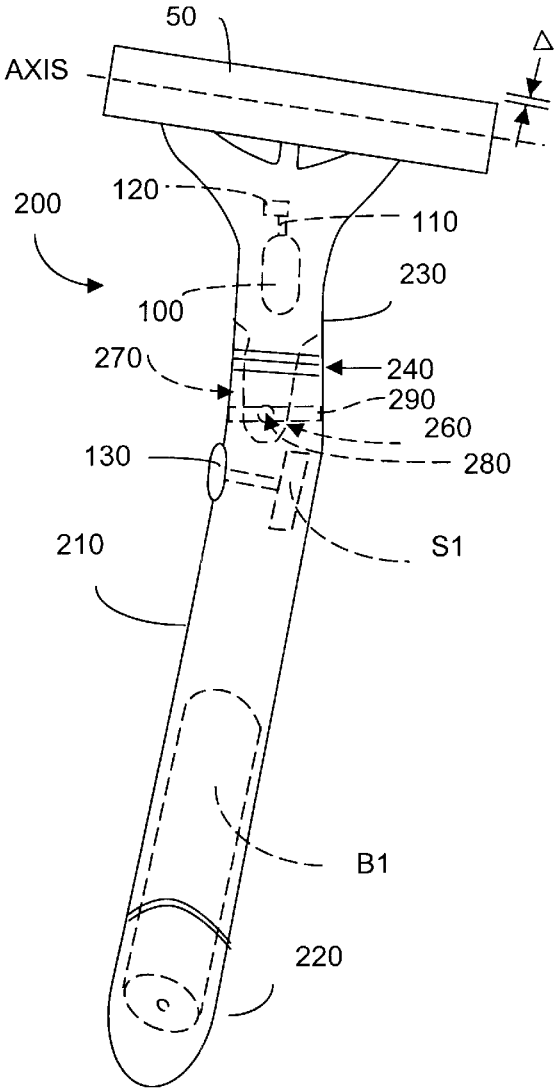
FIG. 3 is a plan perspective view of a second embodiment of the present invention.
Figure 4:
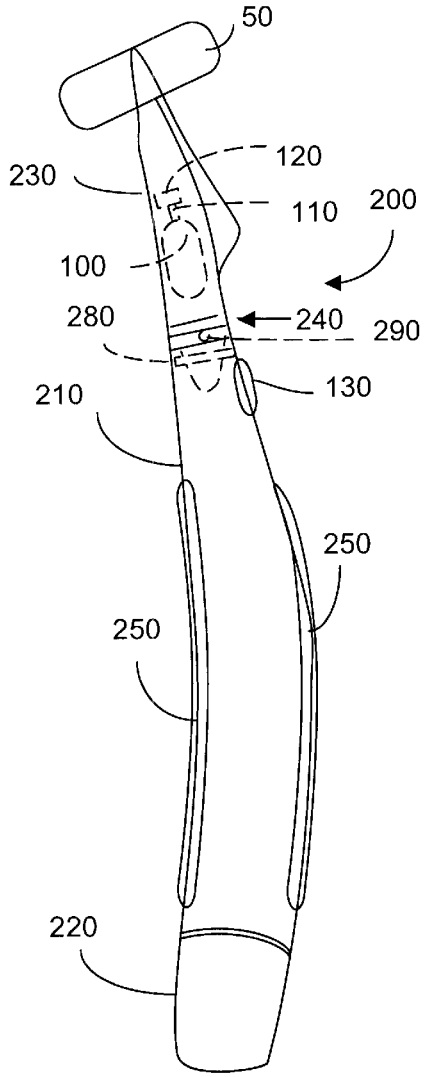
FIG. 4 is a side perspective view of the embodiment of FIG. 3.

However, a disadvantage of system 10 as depicted by FIGS. 1 and 2 is that housing 20 may be uncomfortably large for users having small hands. Turning now to FIGS. 3 and 4, a second and preferred embodiment of a shaving system 200 is shown in which a motorized handle, essentially dedicated to a specific type of razor blade, is provided.

System 200 includes a bifurcated housing comprising a central body portion 210, a foot portion 220, and a head portion 230 to whose distal end an associated razor blade 50 attaches in standard fashion. Razor blade 50 preferably is an off-the-shelf commercially available refill blade. The distal end of head portion 230 is fabricated to mate with and attach to razor blade 50 for shaving.

Disposed within the housing, preferably within central housing portion 210, is a battery power supply, for example at least one AA 1.5 VDC cell B1, access to which is gained by unscrewing foot member 220 from central member 210 for battery replacement purposes. For ease of illustration, FIG. 3 does not depict electrical wiring to and from B1. An ON/OFF switch S1 is also disposed within the central housing portion 210 and is activated when a user pushes on a rubber member 130. If necessary, an extension shaft may be attached to S1 such that user pressure on member 130 pushes the shaft into S1, which forces S1 to toggle from ON to OFF or vice versa. In this fashion an inexpensive switch may be used for S1. Optionally anti-friction strips or pieces of rubber or rubber-like material 250 may be attached to the central housing portion 210 for ease of holding by a user of system 200.

Preferably central housing portion 210 is separated from head housing portion 230 by a rubber coupling 240 that is intended to reduce transmission of vibrations from the distal housing portion 230 into the hand-held central housing portion 210. In the preferred embodiment, the interface between housing portions 210 and 230 is implemented by forming a projection 260 on housing portion 230 that fits within a hollow region 270 formed in housing portion 210. An axle pin 280 joins housing portions 210 and 230 such head housing portion 230 can pivot left and right (as oriented in FIG. 3) relative to central housing portion 210. Thus, in FIG. 3, axle pin 280 is normal to the plane of the paper containing the figure. Alternatively, an axle pin 290 could be disposed at a 90° offset as indicated, in which case relative pivot motion would be up and down, e.g., into and out of the plane of the paper containing the figure. The pivot movements in fact result from vibrations, as described below.

Disposed in the upper or head housing portion 130 is a DC motor 100 whose shaft 110 rotates at perhaps 4,000 RPM to 8,000 RPM when S1 couples operating voltage from B1 to the motor windings. Similar to what was described with respect to FIG. 1, an eccentric weight 120 is attached to shaft 110 to intentionally induce vibrations. With axle pin 280 disposed as shown, system 200 produces vibrations that effectively preferably move razor 50 back and forth a distance Δ approximating the width of a human hair, e.g., about 0.004". The combination of providing a vibration axis for weight 130 that is parallel to the blade axis (AXIS) or razor 50, and providing a rubber joining mechanism 240 advantageously reduces vibrations felt by a user's hand while holding central portion 210 during actual shaving. Again, similarly to system 100, system 200 preferably constrains vibrations about a single axis, although if desired dual axis vibrations could be generated in either embodiment.

Using system 200 simply requires the user to activate switch S1, which couples battery B1 to the winding of motor 100, whereupon vibrations are produced at the razor head 50. The user then shaves in the normal manner, but can enjoy a smoother shave as the vibrations produced by the present invention will reduce friction between the skin on the user's face (or other body portion being shaved) and the cutting edge of the razor 50. When shaving is complete, the user simply presses or otherwise activates S1 to turn motor 100 OFF. Razor head 50 may be replaced in conventional fashion, and typically will be attached to head housing portion 230 by sliding head 50 into mating portions of head housing portion 230, or by clipping head 50 to clip-on regions of head housing portion 230. Thus it is seen that a potential disadvantage of system 200 is that the system is essentially dedicated to a given type of razor system. One cannot necessarily readily fit a different type of razor head 50 to head housing portion 230, instead head housing portion 230 will have been manufactured to accept a given type of razor system 50. On the other hand, system 200 is quite compact and is not a great deal bulkier than some conventional manual shaver systems.

Either embodiment of shaving system described can provide many months of shaving with a single set of easily replaceable batteries. Both shaving systems can reduce friction associated with shaving, and can contribute to a more comfortable shaving experience.

Modifications and variations may be made to the disclosed embodiments without departing from the subject and spirit of the invention as defined by the following claims.

What is claimed is:

1. A shaving system, comprising:

a handholdable housing having a centered housing portion, and a distal housing portion, which distal housing portion has a distal tip adapted to receive a razor blade;

said centered housing portion pivotally joined to said distal housing portion by a pivot axle;

a DC motor having a rotatable shaft, disposed in said housing;

an eccentric weight attached to said shaft of said motor; and a compartment in said housing sized to receive a battery coupleable to energize said DC motor so as to vibrate at least a portion of said distal tip and a razor blade attached thereto.

2. The shaving system of claim 1, wherein:

said handholdable housing comprises a distal portion that includes said distal tip, said DC motor and said eccentric weight being disposed in said distal portion, said handholdable housing further comprising a hand holdable portion that is pivotably joined to said distal portion by a pivot axis.

3. The system of claim 1, wherein:

said eccentric weight and said rotatable shaft are disposed within said housing to produce vibrations having a vibration axis parallel to an axis of said razor blade.

4. The system of claim 1, wherein said pivot axis is disposed relative to an axis of rotation of said eccentric weight so as to produce vibrations having a vibration axis parallel to an axis of said razor blade.

5. The system of claim 1, wherein:

said eccentric weight and said rotatable shaft are disposed within said housing to produce vibratory movement of said razor blade, said movement approximating a dimension of a human hair.

6. The system of claim 1, wherein said movement is approximately 0.004".

7. The system of claim 1, wherein said motor rotates at a speed in a range of about 4,000 RPM to about 8,000 RPM.

8. A method to reduce friction when using a manual shaver of the type having a handle to which a replaceable razor blade is attached, the method including the following steps:

(a) mounting an eccentric weight on the shaft of a DC motor; and (b) mechanically coupling vibrations produced by said motor when energized with DC to said handle such that said razor blade is vibrated to produce vibratory displacement approximating a dimension of a human hair.

9. The method of claim 8, wherein step (a) includes disposing said eccentric weight to vibrate in a vibration axis parallel to a cutting axis of sais razor blade.

10. The method of claim 8, wherein:

said motor and said eccentric weight are disposed in a single housing mechanically attached to said handle.

11. The method of claim 8, wherein:

said motor, said eccentric weight, and a source of said DC are disposed in a single housing mechanically attached to said handle.

12. The method of claim 8, wherein:

said motor and said eccentric weight are disposed in a single housing mechanically attached to said handle, said housing adapted to frictionally retain a generic shaver.

13. The method of claim 8, wherein:

said motor and said eccentric weight are disposed in a single housing comprising said handle.

14. The method of claim 8, further including providing user-operable means for coupling a source of DC to said motor.

15. A shaving system, comprising:

a handholdable housing having a centered housing portion and a distal housing portion which distal housing portion is adapted to receive a razor blade;

a DC motor having a rotatable shaft, disposed in said distal housing portion;

an eccentric weight attached to said shaft of said motor;

a compartment in said central housing portion sized to receive a battery coupleable to energize said DC motor so as to vibrate at least a portion of said distal tip and a razor blade attached thereto; and a pin connection between said distal housing portions and said central housing portion.

16. The shaving system of claim 15 wherein:

said pin connection causes said distal housing portion to vibrate in substantially a single plane.

* * * * *

UNITED STATES PATENT AND TRADEMARK OFFICE

CERTIFICATE OF CORRECTION

PATENT NO. : 6,481,104 B1
DATED : November 19, 2002
INVENTOR(S) : Andrew Parker et al.

It is certified that error appears in the above-identified patent and that said Letters Patent is hereby corrected as shown below:

Column 6,
Lines 44-65, delete Claims 2, 4, 5 and 6, and insert therefor the following corrected claims:

2. The shaving system of claim 1, wherein:

said handholdable housing comprises said distal housing portion that includes said distal tip, said DC motor and said eccentric weight being disposed in said distal housing portion.

4. The system of claim 1, wherein said pivot axle is disposed relative to an axis of rotation of said eccentric weight so as to produce vibrations having a vibration axis parallel to an axis of said razor blade.

5. The system of claim 1, wherein:

said eccentric weight and said rotatable shaft are disposed within said housing to produce vibratory movement of the razor blade, said movement approximating a dimension of a human hair.

6. The system of claim 5, wherein said movement is approximately 0.004".

UNITED STATES PATENT AND TRADEMARK OFFICE

CERTIFICATE OF CORRECTION

PATENT NO. : 6,481,104 B1
DATED : November 19, 2002
INVENTOR(S) : Andrew Parker et al.

It is certified that error appears in the above-identified patent and that said Letters Patent is hereby corrected as shown below:

Column 7,
Lines 1-13, delete Claims 8 and 9 and insert therefor the following corrected claims:

8. A method to reduce friction when using a manual shaver of the type having a handle to which a replaceable razor blade is attached, the method including the following steps:

(a) mounting an eccentric weight on the shaft of a DC motor;

(b) mechanically coupling vibrations, produced by said motor when energized with DC, to said handle such that said razor blade is vibrated to produce vibratory displacement approximating a dimension of a human hair; and (c) producing said handle with a central housing portion connected to a distal housing portion with a pivot axis, said distal housing portion adapted to mount a replaceable razor blade.

9. The method of claim 8, wherein step (a) includes disposing said eccentric weight to vibrate in a vibration axis parallel to a cutting axis of said razor blade.

Signed and Sealed this

Twentieth Day of May, 2003

JAMES E. ROGAN
*Director of the United States Patent and Trademark Office*